US005353967A

United States Patent [19]

Toth et al.

[11] Patent Number: 5,353,967

[45] Date of Patent: Oct. 11, 1994

[54] DRY BULK PRESSURE DIFFERENTIAL CONTAINER

[75] Inventors: John J. Toth, Danbury, Conn.; Richard McNealy, Sand Springs, Okla.

[73] Assignee: Northbrook Rail Corporation, Arlington Heights, Ill.

[21] Appl. No.: 48,518

[22] Filed: Apr. 20, 1993

[51] Int. Cl.[5] ..... B65D 88/30; B65D 88/72

[52] U.S. Cl. ..... 222/181; 222/185; 222/637; 406/119; 406/146; 220/1.5

[58] Field of Search ..... 222/630, 637, 185, 181; 406/39, 41, 119, 120, 146; 220/1.5

[56] References Cited

U.S. PATENT DOCUMENTS

| | | | |
|---|---|---|---|
| 3,726,431 | 4/1973 | Botkin | 220/1.5 |
| 3,912,103 | 10/1975 | Gerhard | 220/1.5 |
| 4,381,062 | 4/1983 | Taquol | 220/1.5 |
| 4,416,384 | 11/1983 | Bjurling | 220/1.5 |
| 4,574,986 | 3/1986 | Baris et al. | 222/94 |
| 4,593,832 | 6/1986 | Gerhard | 220/1.5 |
| 4,603,788 | 8/1986 | Gerhard | 220/1.5 |
| 4,823,989 | 4/1989 | Nilsson | 406/119 |
| 4,840,282 | 6/1989 | Gerhard | 220/1.5 |
| 4,902,173 | 2/1990 | Hendee et al. | 406/145 |
| 4,917,544 | 4/1990 | Crahan et al. | 406/119 |
| 5,083,673 | 1/1992 | Fossey | 220/1.5 |
| 5,248,227 | 9/1993 | Hidock et al. | 406/119 |

OTHER PUBLICATIONS

Alaska Marine Lines "Guidelines for Preparation of Proposal to Manufacture a Dry Bulk Pneumatic Discharge Container", Jul. 1991.

Alaska Marine Lines "Application Guidelines and General Information for AML's Preferred Coating/Paint System", Jul. 1991.

*Primary Examiner*—Karen B. Merritt

*Attorney, Agent, or Firm*—Robert E. Browne; Thomas C. McDonough

[57] ABSTRACT

A container used for transporting dry bulk product which can be loaded and unloaded using a pneumatic mechanism and without need for tipping the container, comprising a plurality of hoppers, an external frame, a unique method of connecting the hoppers to the frame using skirt rings at the ends of the frame and side sills, and internal stiffeners between the hoppers, all of which act to provide sufficient strength to the container.

11 Claims, 8 Drawing Sheets

DRY BULK PRESSURE DIFFERENTIAL CONTAINER

BACKGROUND OF THE INVENTION

This invention relates in general to shipping containers used to transport flowable dry bulk goods. In order to economically transport dry bulk goods, it is necessary to use a sufficiently large container that can be transported by a variety of means, including by truck, sea or rail, and the container must be easily loaded and unloaded using commonly available apparatus. It is known in the art to use hoppers, tanks and similar containers for transporting both dry goods and liquid product. However, such known containers suffer from design flaws which make them difficult and/or uneconomical to use. Specifically, the dry goods containers presently on the market require that the container be tipped to unload the product. Such a design is undesirable because of the problems inherent in tipping such a large device.

Furthermore, in order to be commercially acceptable, such a freight container must be designed and built to internationally recognized standards such as those issued by the United Nations, the International Standards Organization (ISO) and the Association of American Railroads (AAR). These organizations promulgate standards for such containers relating to all facets of handling and carriage, including, among other things, strength, size, weight and materials used in the construction of the container. Applicable standards for containers such as the one disclosed herein include the ISO 1496/IV, AAR M-930, the United Nations' Council for Safe Containers (CSC) and Customs/TIR.

In order to withstand the testing dictated by the above standards to simulate actual operation of the container, such containers require additional support. Many containers known in the prior art use internal stiffener rings and similar structural support members. However, these designs create internal cavities or pockets which can trap product and which reduce the internal size of the container. Other designs use an internal frame for additional support. However, an internal frame reduces the internal volume in the container and thus makes the container less efficient. Therefore, it is preferred to use an external frame with such containers.

Shipping containers which are cylindrical in shape and which are commonly used with liquid product are unacceptable for use with dry product because the cylindrical shape does not allow a sufficient amount of cubic space within the frame.

Other currently available containers on the market use heavier, non-corrosion resistant materials such as carbon steel and are consequently much heavier, use a larger external frame, and have not been tested or certified to all of the standards as the current invention. Thus, those containers are not commercially economical for the regular transport of dry bulk commodities such as food products, pharmaceuticals and products sensitive to contamination. Furthermore, the designs currently available on the market do not conform to all the regulatory requirements set forth by the various governing bodies and are thus not acceptable for many applications.

Thus it has been widely recognized in the field that there is a need for an affordable, efficient dry bulk product transport container that satisfies the various testing requirements for certification by regulatory bodies and does not require tipping in order to unload product from the container.

SUMMARY OF THE INVENTION

It is an object of this invention to disclose a dry bulk product transport container that can be emptied without the need to tip the container. The container disclosed herein uses a unique shape that allows for maximum internal payload volume while still using bottom slope sheets on the inside of the hoppers having a sufficient angle to allow for efficient off-loading of dry flowable materials.

It is a further object of this invention to provide a dry bulk product transport container that is affordable and uses generally available pneumatic devices to assist in the unloading of product. It is yet another object of this invention to combine these benefits in a dry bulk product container that can be used for shipping by rail, by truck or ship, and which is sufficiently strong to satisfy the testing requirements of organizations such as the ISO and AAR.

This invention comprises a dry bulk goods hopper which may be constructed of stainless steel, aluminum or similar materials. This hopper is fitted inside frame conforming to the external size requirements of the ISO and secured to that frame in a unique and novel manner which increases the strength of the entire assembly. Stainless steel would generally be used for applications such as the shipment of pharmaceutical products, while aluminum would be used for most applications due to its light weight and low cost.

The container in accordance with the present invention is comprised of two hoppers joined together within a frame of ISO standard external dimensions. It is to be understood, however, that this invention could be used with an additional number of hoppers. The irregular, non-circular shape of the vessel creates some difficulty in providing sufficient resistance for off-loading flowable materials under pressure. This invention compensates for this pressure through a unique configuration of structural elements such as the bottom arch and rib elements, and the unique means of connecting the hopper to the frame.

As part of the unique connection of the hopper to the external frame, the invention uses skirt rings formed as part of the external frame. The hopper is mounted within the frame to these skirt rings through the use of lap welds, which allows for ease of manufacture and for additional strength. The skirt elements provide for transfer of longitudinal and bearing forces across a large portion of the vessel body.

Secondary mounting of the hopper to the frame is accomplished through use of a side sill angle connected to the main longitudinal frame member through use of lap welds. This side sill angle provides for efficient transfer of bearing forces, longitudinal and transverse forces. In addition, the hopper incorporates a "T-Bar" stiffener between the two parts of the hopper to further strengthen the construction. Thus, the above design maximizes the force bearing area, which reduces the maximum stresses and the consequent risk of fatigue failure.

Additional benefits of this invention will be made clear upon reading the detailed description of the drawings showing the preferred embodiment of this invention. The description of the preferred embodiment contained herein should not be read as limiting the scope of this invention. This invention should be read as limited by the claims only.

DETAILED DESCRIPTION OF THE DRAWINGS

Figure 1:
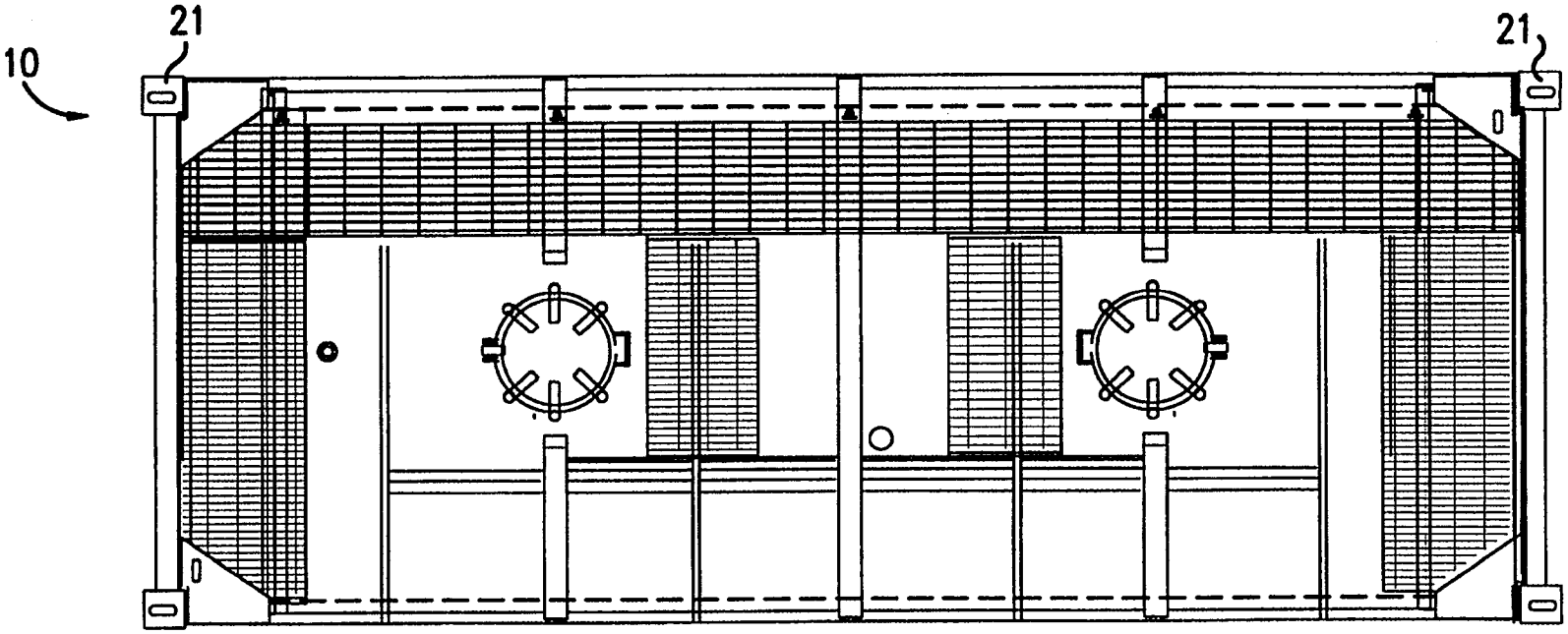
FIG. 1 is a top plan view of the frame of the container assembly in accordance with the present invention and showing the pneumatic mechanisms used therewith.
Figure 2:
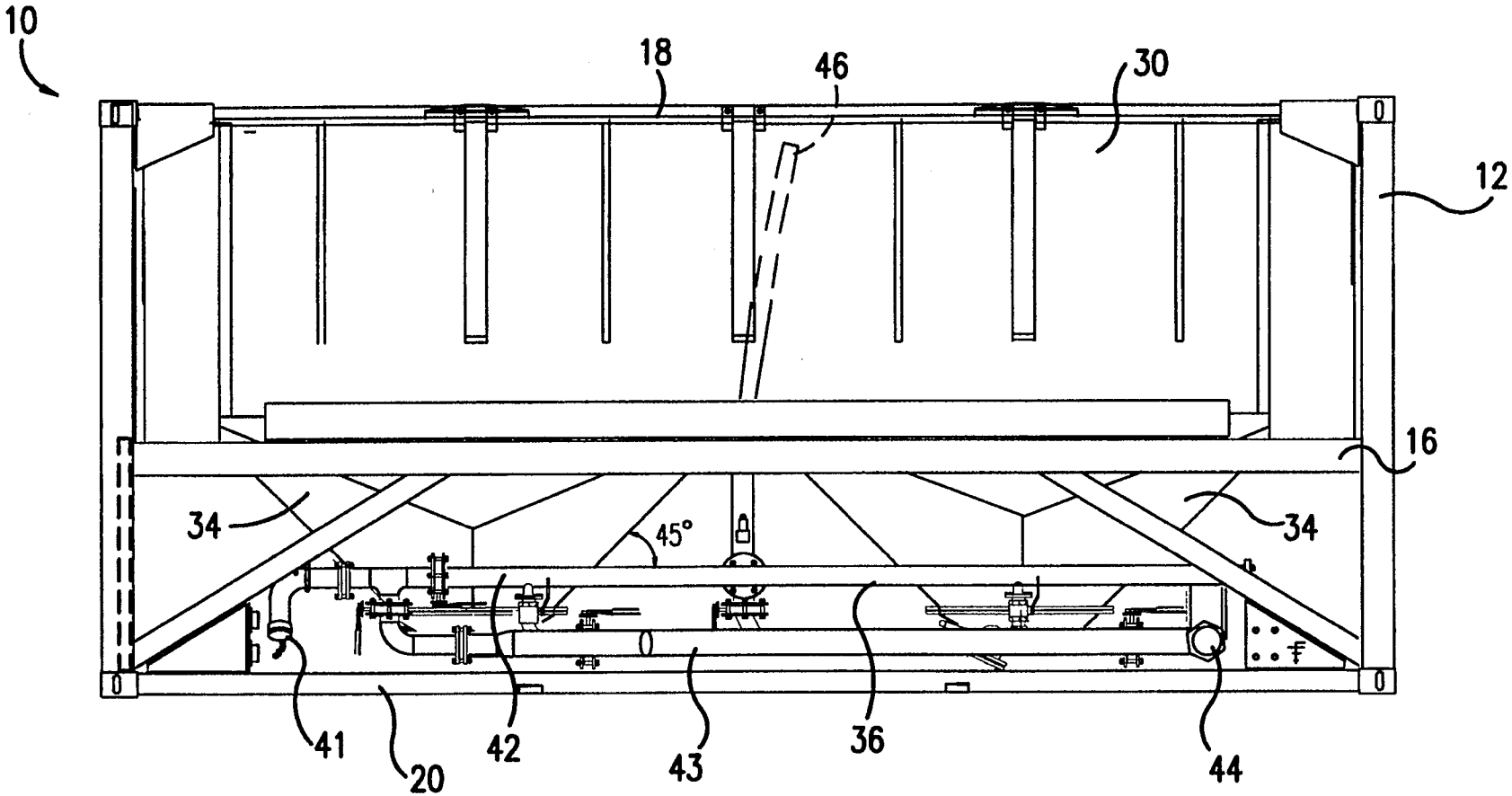
FIG. 2 is a side plan view of the frame of the container assembly in accordance with the present invention and showing the pneumatic mechanisms used therewith.
Figure 3:
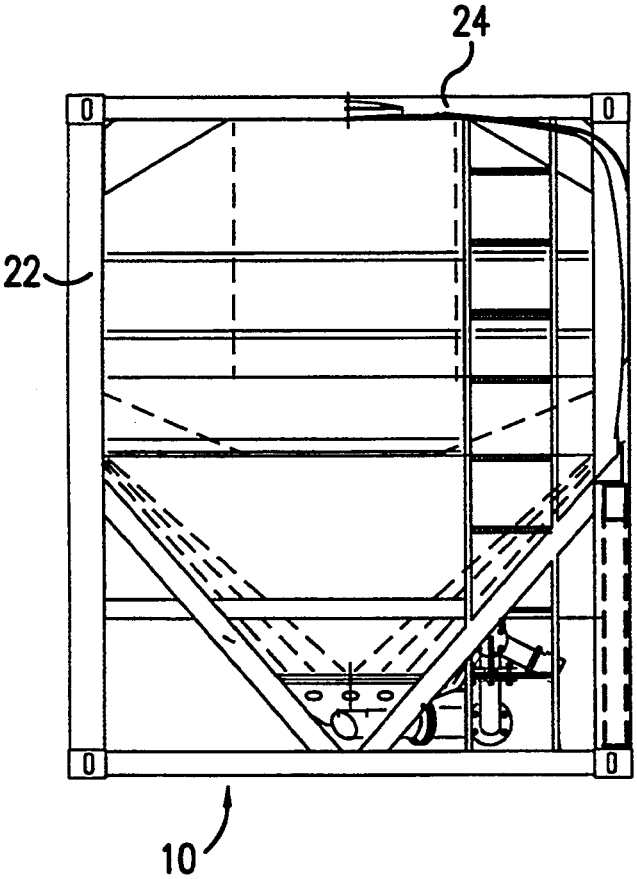
FIG. 3 is an end plan view of the frame of the container assembly in accordance with the present invention and showing the pneumatic mechanisms used therewith.
Figure 4:
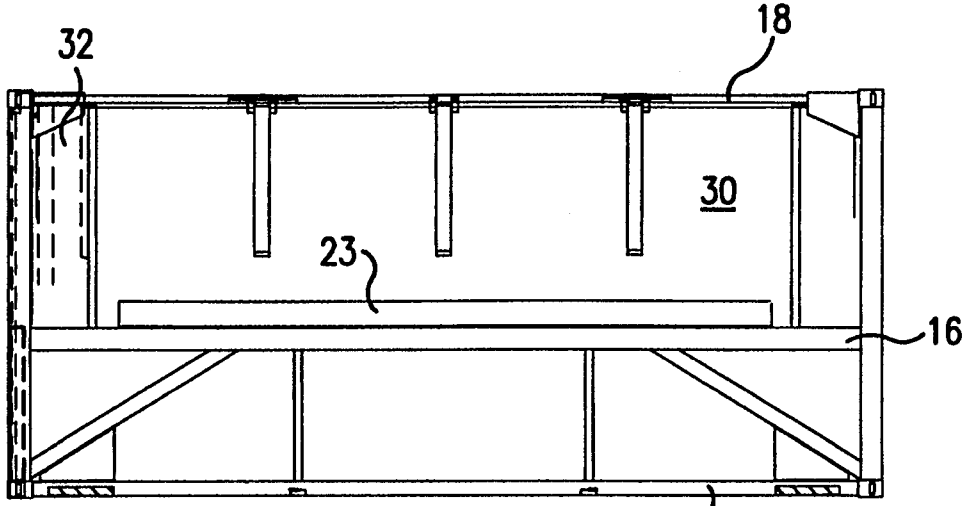
FIG. 4 is a side plan view of the frame of the container assembly in accordance with the present invention.
Figure 5:
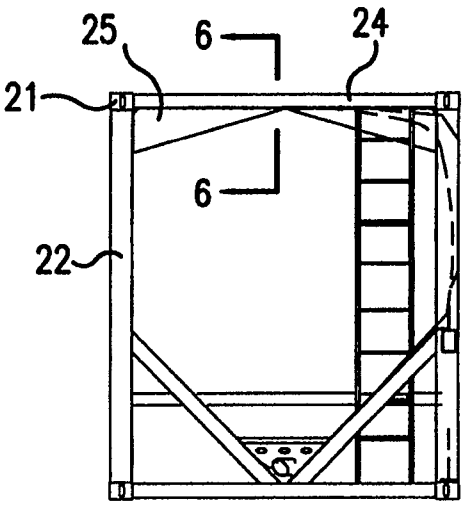
FIG. 5 is an end plan view of the frame of the container assembly in accordance with the present invention.
Figure 6:
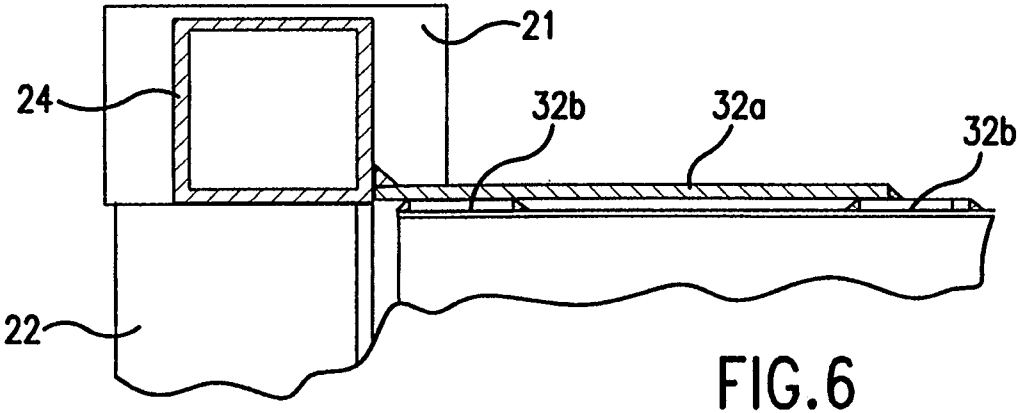
FIG. 6 is cross-sectional view of the skirt ring for the hopper assembly shown along the lines 6—6 in FIG. 5.

The overall preferred embodiment of this invention is shown in FIGS. 1 through 3, which show a container assembly 10 comprising an external frame 12 and vessel 30. Frame 12 comprises center longitudinal beam 16, lower frame member 20 and upper frame member 18. The various elements of the frame are shown in FIGS. 4 through 6 without the pneumatic attachments.

The ends of frame 12 are rectangular in shape and are comprised of vertical and horizontal end units 22 and 24, respectively, which are joined by standard means through corner castings 21. Frame 12 is connected to vessel 30 by means of skirt ring 32. During manufacture, skirt ring 32 may be first welded to end frame members 22 and then welded to vessel 30 using standard arc welds. This method is most convenient for assembly, as the longitudinal dimensions of the vessel can be accurately fixed until the final welds are made.

The use of skirt ring 32 is key to the present invention, as it maximizes the force bearing area and increases the overall strength of the unit. The specific connection of skirt ring 32 to frame 12 is shown in FIG. 6, which represents the view along the 6—6 axis shown in FIG. 5. Skirt ring 32 actually consists of an outer plate **32*a*, which is preferably composed of carbon steel, and an inner plate 32*b*** which is preferably composed of stainless steel.

Figure 10:
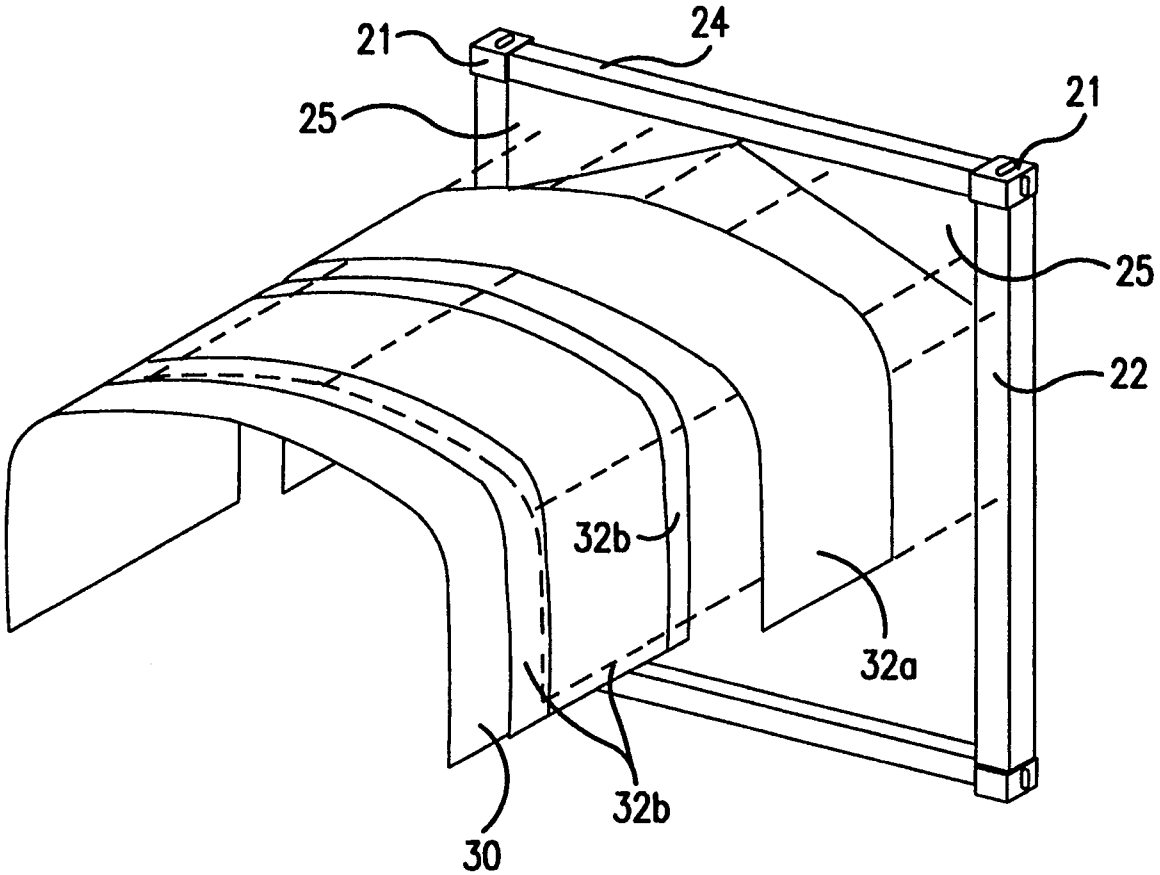
FIG. 10 is an exploded isometric view of the skirt ring used for the connection of the frame to the hopper.

The use of skirt ring 32 to connect the frame 12 to the vessel 30 is shown in more detail in FIG. 10. Specifically, outer plate **32*a* is welded to frame vertical end units 22, horizontal end units 24 and cross supports 25. This construction can be used at both ends of the unit in identical fashion. Inner plate 32*b* is welded to vessel 30**, with the area of contact between the two dissimilar metals being minimized to reduce weight and electrolysis.

Figure 7:
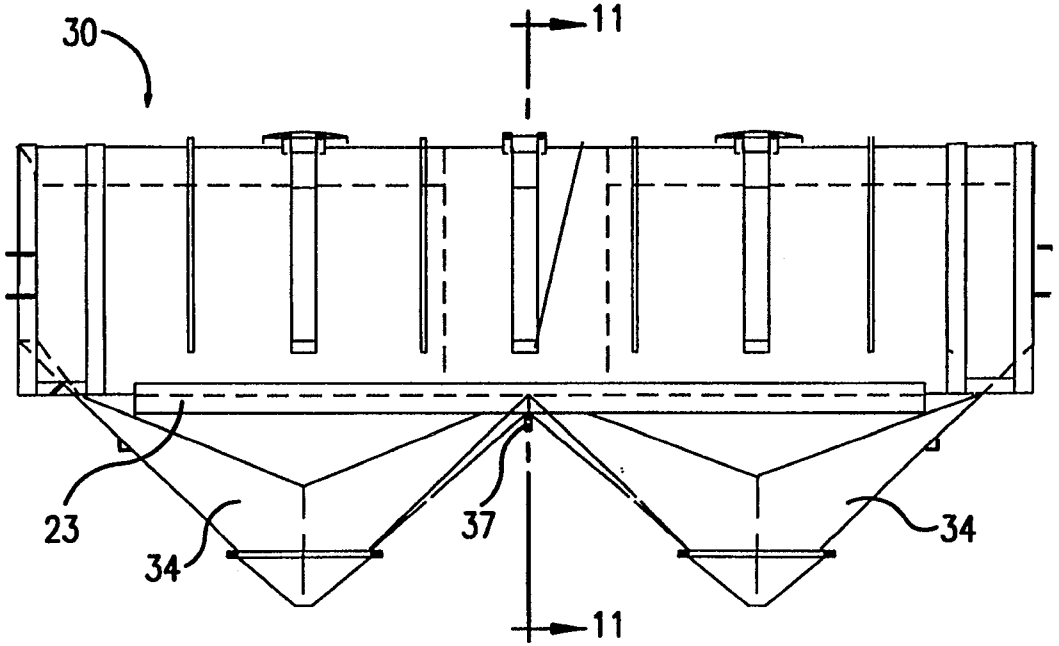
FIG. 7 is a side plan view of the hopper for the container assembly in accordance with the present invention.
Figure 12:
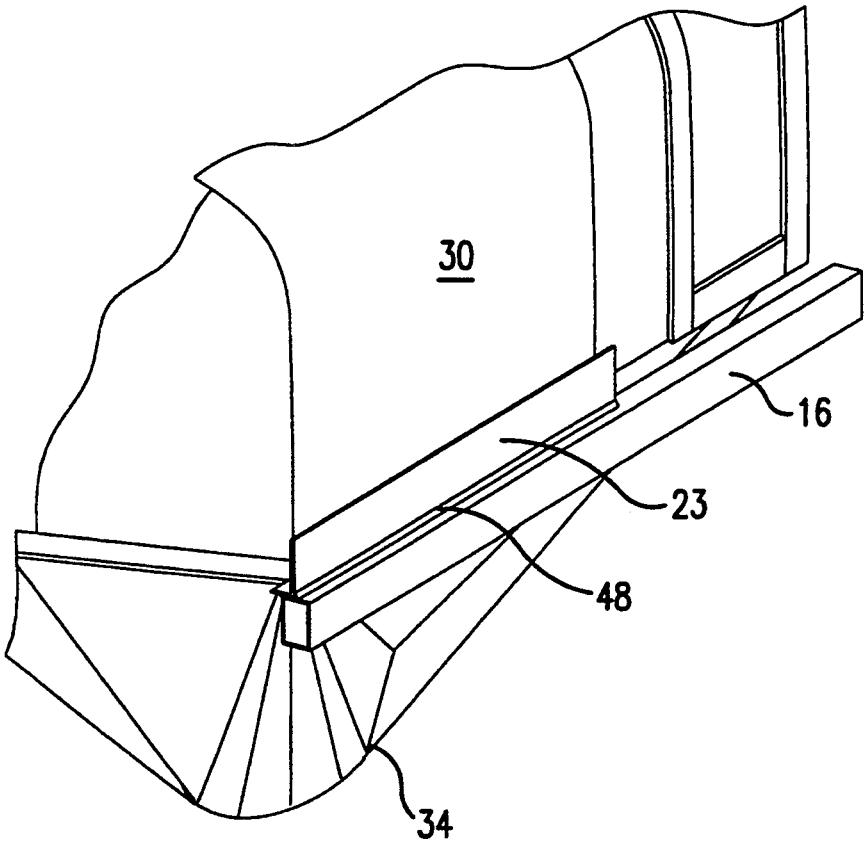
FIG. 12 is a partial isometric view of the vessel assembly and the connection of the vessel to the frame in accordance with the present invention.
Figure 13:
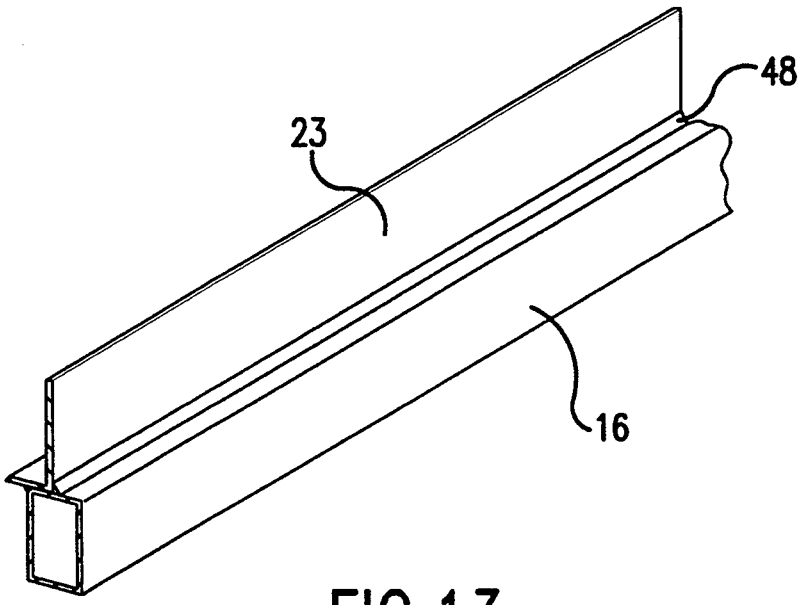
FIG. 13 is a partial isometric view of the side sill used to connect the vessel to the frame.

As shown most clearly in FIG. 13, longitudinal beam 16 includes a sill 23 welded thereto by weld 48, which may be a standard arc weld. FIGS. 7 and 12 show sill 23 as it is welded to the side of vessel 30 using a standard lap weld. The use of sill 23 is key to this invention as it helps to transfer the bearing, longitudinal and transverse forces imposed on the structure during transport and unloading.

The pneumatic mechanism used with container 10 is shown in FIG. 2 and is a type generally known in the art. Specifically, this mechanism creates a pressure differential in vessel 30 to apply gas pressure to the contents of the vessel. This pressure makes the contents at the bottom of the hoppers 34 fluid, which along with gas pressure in the pneumatic system forces the product in hoppers 34 out through openings formed at the bottom thereof (not shown) to minimize the amount of time required to off-load the product. The hoppers 34 are shaped at the bottom to give the slope sheets at the bottom of the hoppers an angle of 45 degrees, as shown in FIG. 2, to facilitate off-loading of the product. As also shown in FIG. 2, the pneumatic system includes air input 41 and air pipe 42, which are connected to hoppers 34 and to product pipe 43, which discharges product through product discharge outlet 44. The pneumatic system also incorporates blow-down pipe 46, which is of a design known in the art for discharging product.

Figure 8:
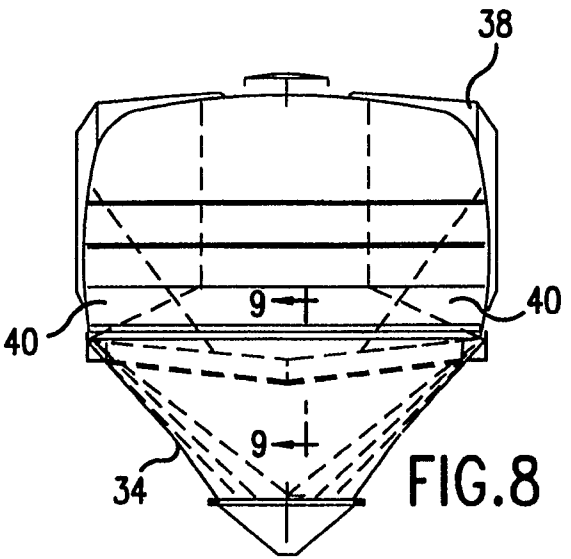
FIG. 8 is an end plan view of the hopper for the container assembly in accordance with the present invention.
Figure 9:
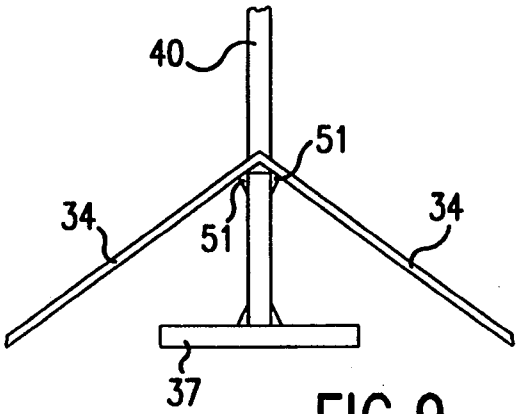
FIG. 9 is cross-sectional view of the stiffening members used in the hoppers for the container made in accordance with this invention along the lines 9—9 in FIG. 8.
Figure 11:
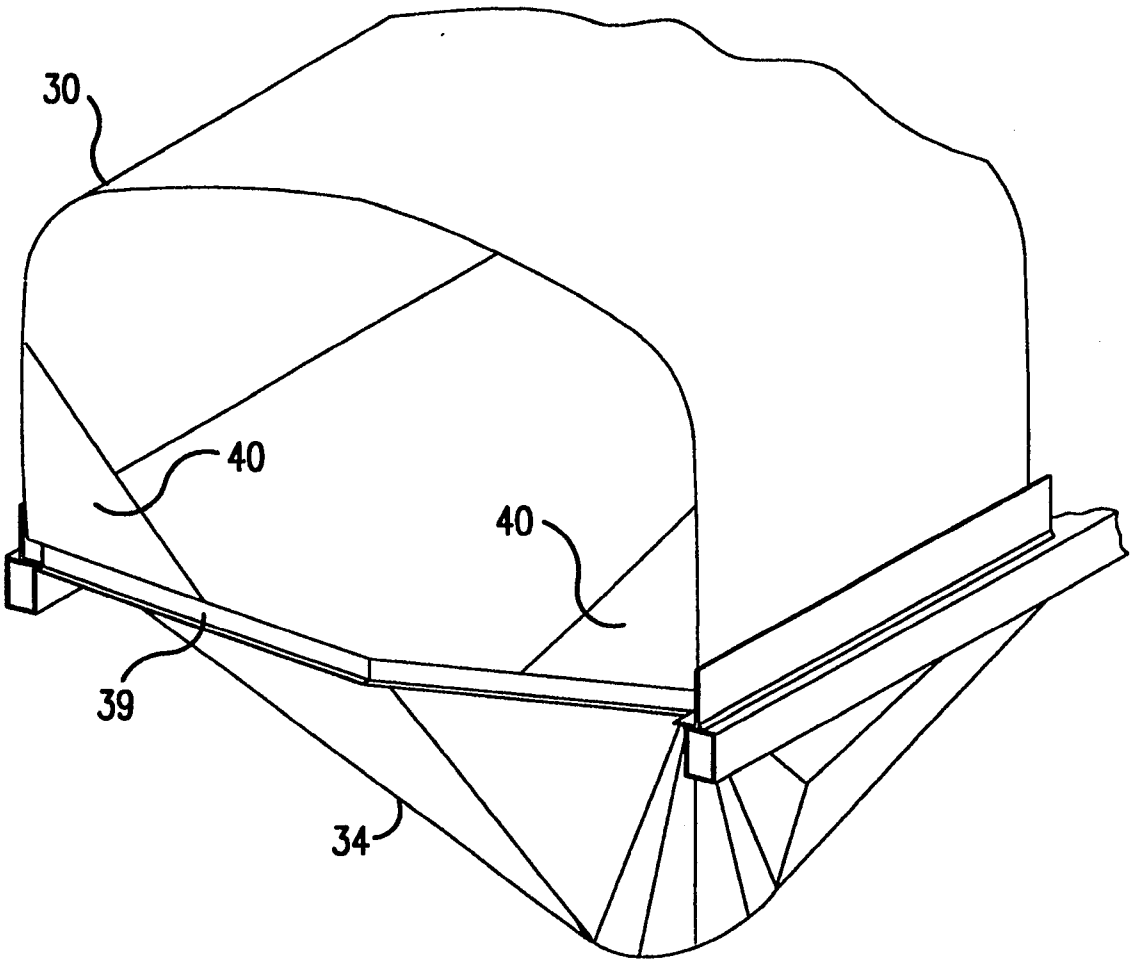
FIG. 11 is an isometric view of the vessel assembly in accordance with this invention along the line 11—11 in FIG. 7.

Vessel 30, shown most clearly in FIGS. 7 and 8, includes two bottom hoppers 34 in the preferred embodiment, although it is to be understood that additional hoppers could be used. The pressures created by the pneumatic system create significant pressures on hoppers 34. The present invention compensates for this additional pressure through the use of additional stiffener bar 37, as shown in FIG. 9, located between and welded to the two hoppers 34 through standard lap welds 51. In addition, the use of external stiffening ribs 38 and arch 40, which is integrally formed on the interior of the hopper, provide additional support for the container. FIG. 9 shows a partial view of the internal arch 40 along with the connection of stiffener bar 37 welded to the hoppers 34. FIG. 11 most clearly shows the connection of arch 40, which is comprised of two triangular pieces attached to cross-beam 39 between the two hoppers 34 to provide additional support therein.

We claim:

1. A container for storing and transporting dry bulk product, comprising a) a vessel for holding and storing said dry product, said vessel comprising at least one non-cylindrical hopper having a top, bottom and plurality of sides;

b) means for unloading said product from the bottom of said vessel; and c) an external frame secured to said vessel, wherein said frame is comprised of
   i) a first end piece and a second end piece located opposite of said first end piece, each said end piece having a top portion, a bottom portion and at least a first and second side portions connecting said top portion to said bottom portion;
   ii) a plurality of longitudinal members connecting said end pieces;
   iii) at least one longitudinal member having a sill securely connected thereto, and said sill being securely connected to one of said sides of said vessel; and
   iv) an attaching means securely fastened to each of said end pieces and to a portion of said vessel.

2. A container as set forth in claim 1, wherein said vessel comprises a plurality of hoppers joined to one another, each said hopper having a generally trapezoidal shape and an opening disposed towards the bottom of said vessel, and a beam disposed between said hoppers and extending from one side of said vessel to the opposite side of said vessel.

3. A container as set forth in claim 2 further comprising an arch located between each said hopper on an internal portion of said vessel and secured to said beam between said hoppers.

4. A container as set forth in claim 1, wherein said vessel is comprised of stainless steel.

5. A container as set forth in claim 1, wherein said vessel is comprised of aluminum.

6. A container for storing and transporting dry bulk product, comprising
   a) a vessel for holding and storing said dry product, said vessel having a top, bottom and plurality of sides;
   b) means for unloading said product from the bottom of said vessel using a pneumatic mechanism; and
   c) an external frame secured to said vessel, wherein said frame is comprised of
      i) a first end piece and a second end piece located opposite of said first end piece, each said end piece having a top horizontal member and a bottom horizontal member and at least a first and second vertical member connecting said top member to said bottom member;
      ii) a plurality of first longitudinal members connecting said end pieces near the top thereof;
      iii) a plurality of second longitudinal members connecting said end pieces near the bottom thereof;
      iv) at least one first center longitudinal member connecting said first vertical member of said first end piece to said first vertical member of said second end piece, and a first sill securely connected to said first center longitudinal member and to one of said sides of said vessel;
      v) at least one second center longitudinal member connecting said second vertical member of said first end piece to said second vertical member of said second end piece, and a second sill securely connected to said second center longitudinal member and to one of said sides of said vessel;
      vi) a first skirt ring securely fastened to said first end piece and to a portion of said vessel;
      vii) a second skirt ring securely fastened to said second end piece and to a portion of said vessel.

7. A container as set forth in claim 6, wherein said first and second skirt rings comprise an external plate comprised of carbon steel, and said external plate is securely fastened to said frame and an internal plate comprised of stainless steel and securely fastened to said external plate, wherein said internal plate is securely connected to said vessel and has a smaller surface area than said external plate.

8. A container as set forth in claim 7, wherein said external plate is fastened to said frame by means of a lap weld.

9. A container as set forth in claim 6, wherein said vessel comprises a plurality of hoppers joined to one another, each said hopper having a generally trapezoidal shape and an opening disposed towards the bottom of said vessel, and a beam disposed between said hoppers and extending from one side of said vessel to the opposite side of said vessel.

10. A container as set forth in claim 9 further comprising an arch located between each said hopper on the internal portion of said vessel and secured to said beam between said hoppers.

11. A container as set forth in claim 6, wherein said first and second sills are connected to said frame by means of a lap weld.

* * * * *